United States Patent [19]

Ohashi

[11] Patent Number: 4,594,859

[45] Date of Patent: Jun. 17, 1986

[54] ICE SKATING RINK

[75] Inventor: Kazuo Ohashi, Tokyo, Japan

[73] Assignee: Kabushiki Kaisha Patine Shokai, Tokyo, Japan

[21] Appl. No.: 707,080

[22] Filed: Mar. 1, 1985

[51] Int. Cl.[4] ..... A63C 19/10

[52] U.S. Cl. ..... 62/235; 405/130; 405/234

[58] Field of Search ..... 62/235; 405/130, 234

[56] References Cited

U.S. PATENT DOCUMENTS

| | | | |
|---|---|---|---|
| 2,997,770 | 8/1961 | Beltz | 62/235 |
| 3,015,938 | 1/1962 | Vereyken | 62/235 |
| 3,893,507 | 7/1975 | MacCracken et al. | 62/235 |
| 3,910,059 | 10/1975 | MacCracken | 62/235 |
| 3,986,342 | 10/1976 | MacCracken | 62/235 |

FOREIGN PATENT DOCUMENTS

| | | |
|---|---|---|
| 537419 | 2/1957 | Canada . |
| 3003069 | 7/1980 | Fed. Rep. of Germany . |

*Primary Examiner*—Ronald C. Capossela

*Attorney, Agent, or Firm*—Frishauf, Holtz, Goodman & Woodward

[57] ABSTRACT

An ice rink for speed competition skating has a rink floor which is divided into longitudinal spans or sections by recesses extending transversely of the freezing zone of the rink. On each span or section, there are disposed side-by-side a large number of freezing pipes extending lengthwise of the freezing zone. Refrigerant supply and return headers are provided in each recess for extending across the recess. The freezing pipes associated with two neighboring spans or sections are introduced into the associated recesses so as to cross one another for connection to the supply and return headers and then to the common freezing unit disposed outside of the recesses. The freezing pipes are retracted into the recesses in the crossing or overlapping portions so that the ice does not become too hard or thick in these portions. The relative height level of the crossing point is also adjustable so as to render the ice layer uniform and smooth in quality.

7 Claims, 9 Drawing Figures

ICE SKATING RINK

BACKGROUND OF THE INVENTION

This invention relates to an ice rink for ice skating in particular.

For making and maintaining an ice layer on an ice rink floor, the conventional method consists in laying a large number of freezing pipes on the rink floor and circulating a freezing medium or refrigerant such as brine, thereby forming and preserving an ice layer on the floor. To this effect, one ends of the freezing pipes are connected to a refrigerant supply header and the other ends of the pipes to a refrigerant return header. These supply and return headers are connected via delivery pipes and return pipes to a freezing unit. The freezing medium is circulated from the cooling unit going through the delivery pipe, the refrigerant supply header, the freezing pipe, the refrigerant return header and the return pipe and back to the cooling unit to complete the freezing cycle.

The freezing pipes may be installed widthwise of the rink, but in such case the number of the freezing tubes inevitably gets increased, causing installetion operation to be complicated with attendant high cost.

Therefore, it is generally preferred to lay the freezing tubes in the longitudinal direction of the rink. However, in laying the freezing pipes in this manner, it is practically difficult to prepare in advance the lengths of the freezing pipes corresponding to the overall rink length. Moreover, freezing pipes with such large length are inconvenient to handle or transport. When the pipes have their sections connected to one another at one or more joints, various disadvantages or problems may be accompanied with respect to the freezing effect. Above all, it must be considered an extremely long skating course is required under the international standards for an ice rink of the speed skating competition, and it is further required that such rink is provided with one or more curved sections, renderring it extremely difficult or impossible to install the freezing pipe having the length sufficient to cover the overall skating course. Incidentally to note, the standard double track for the speed skating ice rink is required to have two straight sections interconnected by two curved sections, these sections being respectively of the same length and placed symmetrically with respect to each other with the course length being 400 or 333⅓ meter and the inner radii of curvature of the curved sections being 29 meter. Therefore, in this speed skating rink, as shown in FIG. 1, the overall course is usually divided into four or eight spans or sections and the resulting junctions 3*a* to 3*d* are provided with respective headers 4. A large number of freezing tubes 5 having the same length as that of the spans or sections 2*a* to 2*d* are laid in the spans 2*a* to 2*d* and the ends of these freezing tubes 5 are connected to the associated headers. In this case, the headers and the freezing tubes are usually mounted at the same relative height level on the rink floor. Since the header 4 is larger in diameter than the tube 5 and thus a larger amount of the freezing medium in allowed to pass therethrough per unit time, the water disposed above the header 4 is cooled more excessively than the water in any other area of the rink so that it is converted into a hardend ice to form an elevated ice layer. Thus, it was not possible to favorably obtain a smooth ice layer of good quality with uniform and homogeneous nature.

It is also known that the freezing pipes and headers are embedded inside of the concrete floor of ice rink for permanent use. In this case, however, the operation of pipe installation requires a great deal of time and labor with commensurate high costs. Moreover, it is impossible to dismount the freezing pipes or the headers when the rink is not in use. Also the cracks may be produced in the embedded portions of the floor over a prolonged time so that the headers may become corroded due to water intrusion with resulting refrigerant leakage, the rink being unable to be repaired even under such conditions.

The present invention has been acomplished to overcome the foregoing drawbacks of the prior art. It is an object of the present invention to provide an ice rink which is cost efficient and in which the freezing pipes can be either mounted or dismounted easily and the ice layer in the vicinity of the headers is kept from becoming too hard or too thick, so that the smooth ice layer of a highly uniform quality may be readily formed and maintained on the overall freezing area of the rink.

BRIEF DESCRIPTION OF THE DRAWINGS

FIGS. 2 to 4 show the first embodiment of the present invention, wherein FIG. 2 is a plan view showing the general disposition of the freezing pipes.

FIG. 3 shows the connection between the freezing pipes and the header.

FIG. 4 is a longitudinal section through the recess.

FIGS. 5 and 6 show the second embodiment of the present invention, wherein FIG. 5 is a side elevation showing the general disposition of the freezing pipes.

FIG. 6 is a longitudinal section through the recess.

FIGS. 7 and 8 show the third embodiment of the present invention, wherein FIG. 7 is a plan view of the recess.

FIG. 8 is a longitudinal section thereof.

DESCRIPTION OF THE PREFERRED EMBODIMENT

Figure 1:
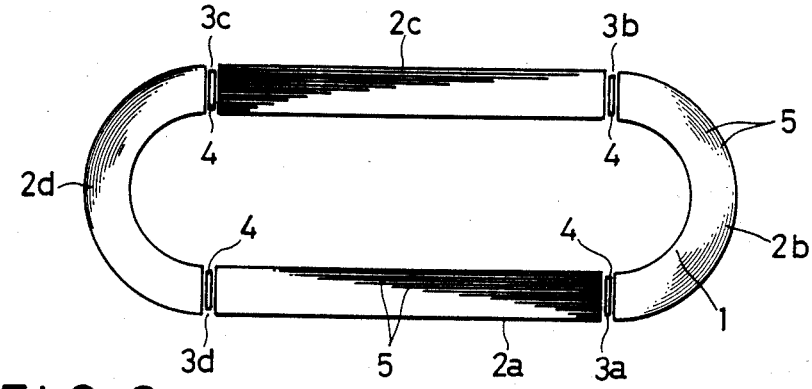
FIG. 1 is a schematic plan view of a speed skating rink commonly in use.
Figure 2:
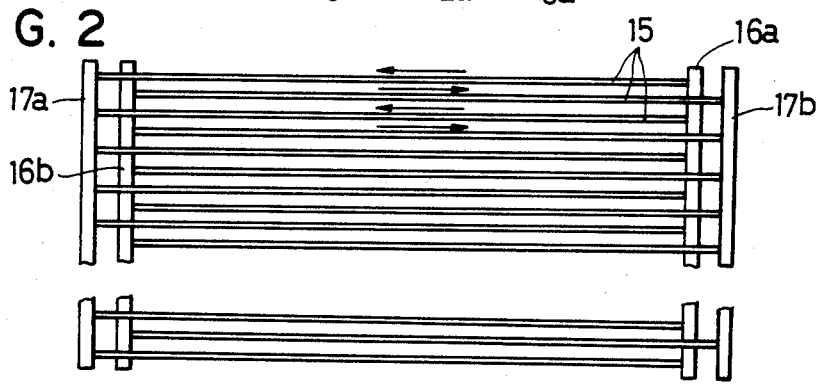
Figure 3:
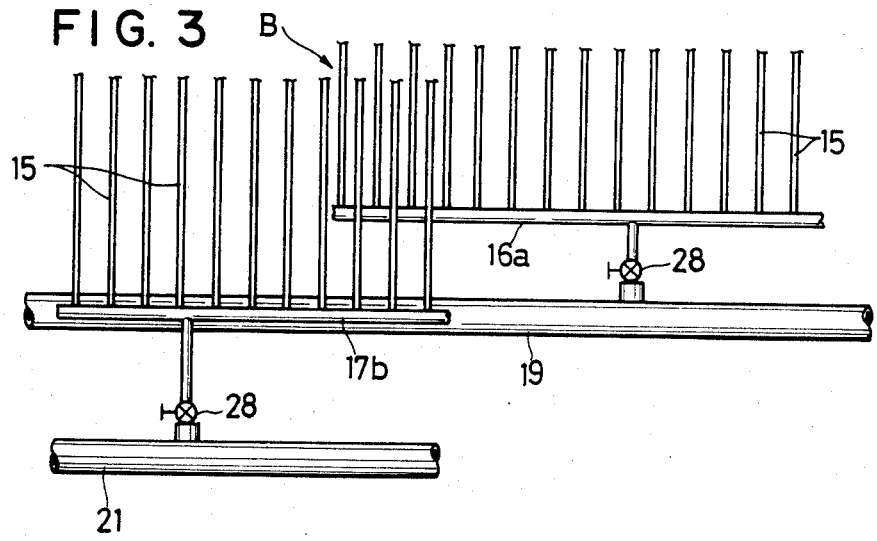
Figure 4:
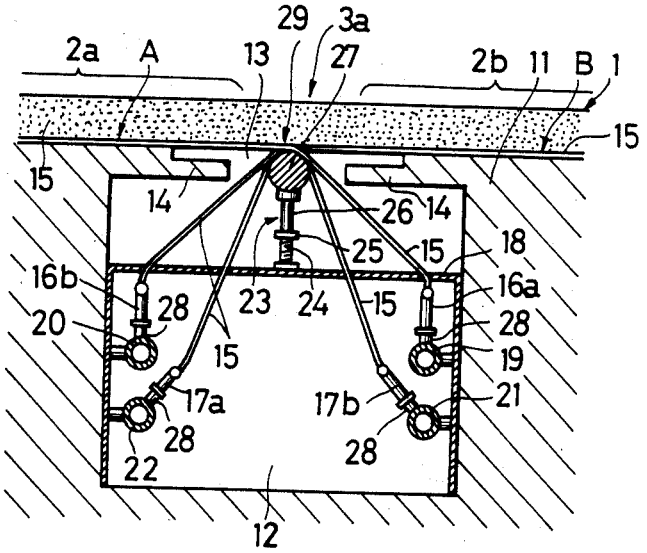

FIGS. 2 to 4 illustrate the first embodiment of the present invention. The manner in which the course of the speed skating ice rink is subdivided into plural spans or sections is similar to that described with reference to FIG. 1 and the detailed description is omitted for simplicity. In the drawing, the numeral 11 designates a rink floor and the numeral 12 a recess provided between adjacent ones of the spans 2*a*, 2*b*, . . . The floor 11 may be fixedly formed, for examples, by concrete or temporarily by flat plants to be usually laid on a swimming pool. The recess 12 is substantially rectangular in section and has a narrow opening 13 defined by flanges 14, 14 and extending widthwise of the course 1. On the floor 11 extending over the spans 2*a*, 2*b*, . . . are arranged a large number of freezing pipes 15, 15, . . . parallel to one another and in the longitudinal direction of the course 1. These freezing pipes 15, 15, . . . are the ethylene vinyle pipes or the like resilient pipes in the inside of which is circulated the freezing medium in a known manner. Each freezing pipe 15 has its one end connected to an inlet sub-header 16*a* and thence to freezing medium supply headers 19, 20 and its other end connected to a sub-header 17*a* and thence to freezing medium return headers 21, 22.

These freezing pipes 15 can be laid on the floor 11 in such a manner that the cooling medium flows in the same direction through all the freezing pipes or in the reverse directions through alternate ones of the pipes. FIGS. 2 and 3 show an example in which the freezing medium flows in the opposite directions in alternate ones of a large number of the freezing pipes 15. The right side ends of alternate pipes 15 are connected to the inlet sub-header 16*a* and the left side ends thereof are connected to the outlet sub-header 17*a*. The right side ends of the remaining pipes 15 are connected to the outlet sub-header 17*b* and the left side ends thereof connected to the inlet sub-header 16*b*. In this manner, the pipes 15 are so arranged that the freezing medium in a given pipe flows in a direction opposite to one in which the freezing medium flows in the adjacent pipes, as indicated by arrow marks in FIG. 2.

In one and other upper sides of a rack 18, provided inside the recess 12, there are mounted a first freezing medium supply header 19 and a second freezing medium supply header 20. Beneath the first and second supply headers 19, 20, there are mounted the first freezing medium return header 21 and the second freezing medium return header 22, respectively. These supply and return headers 19 and 22, respectively. These supply and return headers 19 to 22 are arranged in the longitudinal direction of the recess 12, i.e. in the widthwise direction of the course 1. A cooling pipe supporting fixture 23 is mounted vertically on the upper surface of the rack 18 and in opposition to the opening 13. The fixture 23 serves to support the cooling pipe 15 in the recess 12 and consists of a lifting rod 26 having a screw bolt 24 and a cap nut 25 meshed with the bolt 24 and a supporting rod 27 attached to the upper end of the screw bolt 24. The supporting rod 27 may be moved vertically by rotation of the cap nut 25.

If the freezing pipes 15 mounted on the floor 11 of a first one 2*a* of two neighboring spans on both sides of a given recess 12 is to be termed as the first group A of the freezing pipes, the end of the freezing pipe of the group A forwards the inlet sub-header 16*a* is guided clockwise over the upper surface of the associated fixture 23 to be guided into the recess 12 via opening 13, and the inlet sub-header 16*a* is connected to the first refrigerant supply header 19 by a cock joint 28. The outlet sub-header 17*b* is connected in the similar manner to the first refrigerant return header 21. Similarly, if the freezing pipes 15 placed on the floor 11 of the second span 2*b* is to be termed as the second group B, the end of the cooling pipe 15 of the second group towards the inlet sub-header 16*b* is guided counterclockwise over the upper surface of the associated fixture 23 to be guided into the inside of the recess 12 through the opening 13. The inlet sub-header 16*b* of the second group B is connected to the second freezing medium supply header 20 through a cock joint 28, while the outlet sub-header 17*a* thereof is connected in the similar manner to the second freezing medium return header 22. In this manner, both ends of the freezing pipes 15 of the groups A and B are introduced into the recess 12 and the freezing pipes 15 form a crossed portion 29 on the upper surface of the supporting fixture 23. When the crossing portion 29 is formed in this manner, the cooling pipes 15 of the groups A and B are collected in one place so that the number of the freezing pipes is twice that of the current portion of the freezing system with resulting improvement in the freezing efficiency. This compensates for the lowered freezing capacity otherwise brought about by the extended distance from the ice layer of the ends of the freezing pipes 15 disposed within the recess 12.

It should be noted that the first and second supply headers 19, 20 are connected to a freezing apparatus, not shown, whereas the first and second return headers 21, 22 are connected to the freezing apparatus via a return piping, also not shown, for completing a freezing cycle in a known manner.

In operation, the freezing medium supplied from the first supply header 19 flows through the cooling pipes of the first group A through the inlet sub-header 16*a* so as to flow into the first refrigerant return header 21 through the outlet sub-header 17*b*. The freezing medium supplied from the second supply header 20 flows through the freezing pipes of the second group B through the inlet sub-header 16*b* so as to flow into the second refrigerant return header 22 through the outlet sub-header 17*a*. In this case, when the freezing pipes 15 are arranged as shown in FIGS. 2 and 3, the freezing medium flowing through the neighboring freezing pipes of both the groups A and B flow in opposite directions to each other so as to provide uniform freezing over the whole surface of the course 1. It should be also noted that the height level of the crossing portion 19 in the recess can be freely adjusted by the supporting fixture 23 so as to provide a smooth ice layer of a uniform and homogeous quality for the overall course 1.

Figure 5:
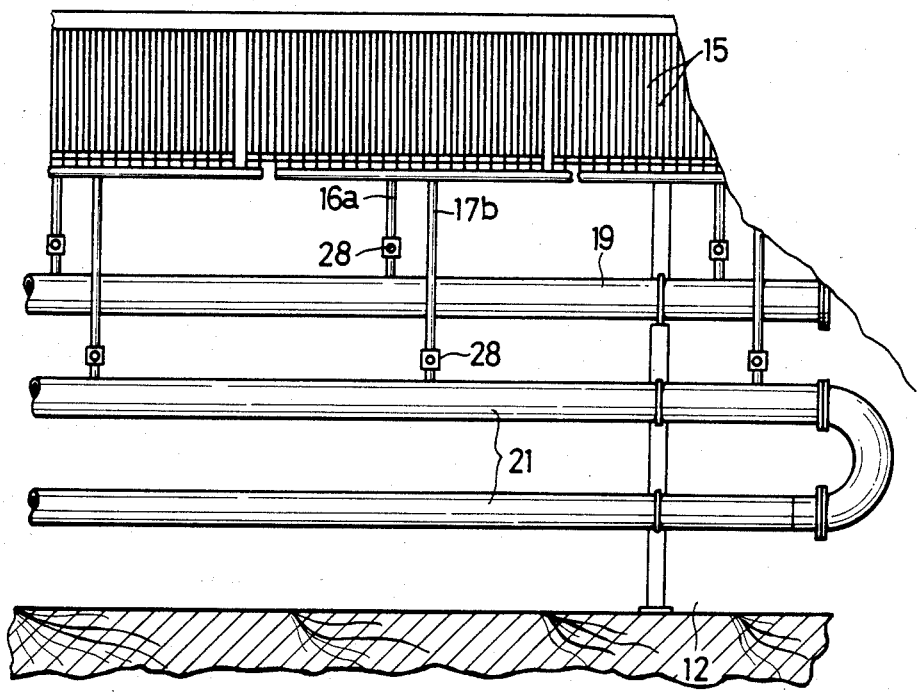
Figure 6:
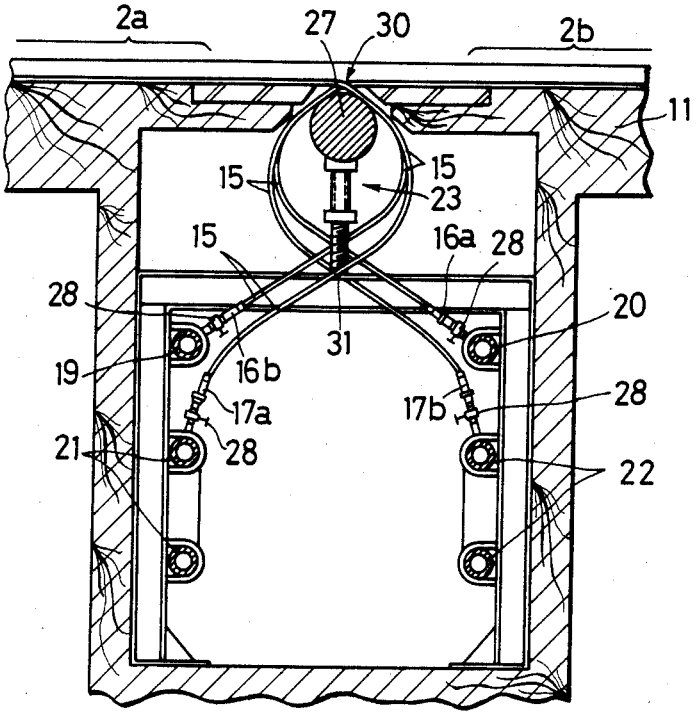

FIGS. 5 and 6 illustrate the second embodiment of the invention. In the present embodiment, the components same as or similar to those of the first embodiment are indicated by the same numerals and the corresponding description is omitted for simplicity. In the present embodiment, the refrigerant supply header 19 and the refrigerant return header 21 connected to the ends of the first group A of the freezing pipes are provided along the side wall of the recess 12 towards the first span associated with the first group A, whereas the refrigerant supply header 20 and the refrigerant return header 22 connected to the ends of the second group B of the freezing pipes are provided along the side wall of the recess 12 towards the second span associated with the second group B. When the supply headers 19, 20 and the return headers 21, 22 are provided in this manner, the freezing pipes of the first and second group A, B form a first crossing 30 on upper surface of the supporting rods 27 of the supporting fixtures 23 and the second crossing 31 beneath the fixtures 23 before being connected to the headers 19 to 22. In this case, the freezing pipes 15 can be dismounted from the cock joints, while the pipes 15 remain connected to the inlet sub-headers 16*a*, 16*b* and the outlet sub-headers 17*a*, 17*b*, so that the operation of pipe installation and the operation of dismounting the freezing pipes 15 that are out of use may be facilitated.

Figure 7:
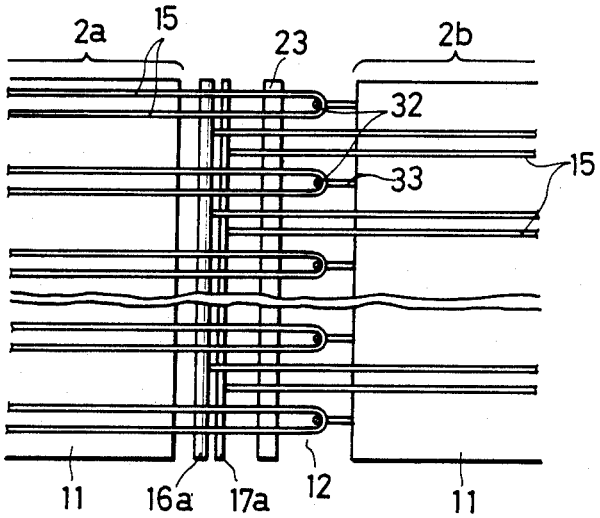
Figure 8:
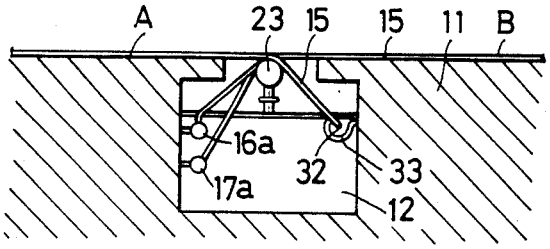

FIGS. 7 and 8 show the third embodiment, wherein the parts or components equivalent to those of the first embodiment of the present invention are indicated by the same numerals and the corresponding description is omitted for simplicity. In the present embodiment, the freezing pipes 15 associated with the spans 2*a*, 2*b* are bent into the shape of a letter U and the ends of both sides of the letter U are separately connected in the recess 12 to the inlet sub-header 16*a* and the outlet sub-header 17*a*. In this manner, the proceeding direction of the freezing medium in one straight section of any given pipe 15 can be reversed to that of the freezing medium in the other straight section of the same pipe. It should be noted that bend 32 of each tube 15 is engaged by a hook 33 provided in an adjoining recess 12 associated with the opposite side of the span and the first and second group A, B of the freezing pipes are associated respectively to the first and second spans *2a, 2b.*

Figure 9:
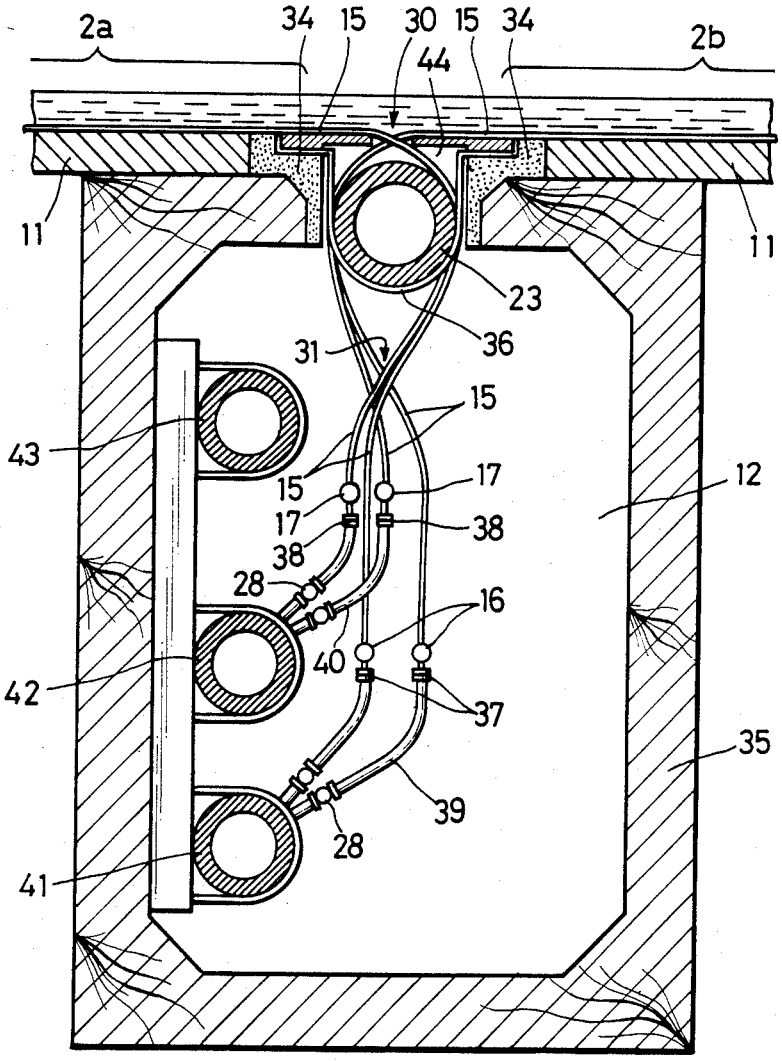
FIG. 9 shows the fourth embodiment of the present invention and is a longitudinal section through the recess.

In FIG. 9, there is shown the fourth embodiment of the present invention, wherein the parts or components equivalent to those shown in FIG. 1 are again indicated by the same reference numerals and the corresponding description is omitted. In the present embodiment, the recess 12 is defined by a channel element 35 having an upper opening 44 which is delimited by a pair of fitting elements 34 holding a carrier 36 with a U shaped cross-section. The refrigerant supply header 41 and the refrigerant return header 42 are provided only to one side wall of the recess 12 and are adapted to be used in common by the first and second groups A and B of the freezing pipes 15. Thus, a pair of flexible tubes 39 formed of rubber or the like are connected by way of joints 37 to inlet sub-headers 16 associated with the respective pipes of the groups A and B, whereas another pair of flexible tubes 40 are similarly connected by way of joints 38 to outlet sub-headers 17 of the pipes 15 of the groups A and B. The flexible tubes 39 connected to the inlet sub-headers 16 of the groups A and B are further connected through cock joints 28 to one and same refrigerant supply header 41. Similarly, the flexible tubes 40 connected to the outlet sub-headers 17 of the groups A and B are further connected through cock joints 28 to one and the same refrigerant return header 42. In the drawing, the numeral 43 designates an equalizer head for adjusting the internal pressure prevailing in the headers 41, 42. In this case, the mounting of the supporting fixture 23 is facilitated. In addition, since only each one of header 41 and header 42 needs be provided in each recess 12, the operation of forming the rink is facilitated with an improved cost efficiency.

In the above embodiments, the proceeding direction of the freezing medium through a given freezing pipe in a given span is reversed to that of the freezing medium through the adjoining pipe of the same span. However, this is not limitative of the present invention and the freezing medium may flow in the same direction in any of the freezing pipes. When the freezing medium is caused to flow in the same direction through the respective freezing pipes, it is only necessary to provide a refrigerant supply header and a refrigerant return header in each recess in any of first to third embodiments described hereinabove.

After installation of the freezing pipes 15, the opening of each recess 12 may be closed by a hood of any suitable material and configuration for preventing water intrusion into the recess. Moreover, the rink can be used in this case for other purposes, for instance, as a swimming pool.

From the foregoing it is seen that the present invention provides an arrangement in which the ice provided with a smooth surface and a uniform may be provided and maintained for the ice rink with a large course length such as speed skating rink. In addition, the freezing tube can be mounted and dismounted easily and the rink may be adapted for other purposes than the ice skating. Also the maintenance operation for the freezing tubes and the refrigerant supply and return headers is facilitated, serving for improved durability and cost efficiency.

What is claimed is:

1. An ice skating rink comprising a multiplicity of freezing pipes arranged on a rink floor and extending in the longitudinal direction of the freezing area of the rink, said pipes having one ends connected to refrigerant supply header means and the other ends connected to refrigerant return header means and the freezing medium circulating through a freezing system including these pipes and the supply and return header means for forming an ice layer on the rink floor, characterized in that the freezing area of the rink is divided into plural spans by recesses extending in the widthwise direction of the freezing area, said freezing pipes are arranged on floor sections associated with the respective spans, said refrigerant supply and return headers and fixture means for supporting the freezing pipes are mounted in said recesses for extending widthwise of the freezing area, the freezing pipes associated with any two adjacent spans disposed on either side of the recesses are placed over said fixture means so as to cross one another, and the one ends of the respective freezing pipes are connected to said refrigerant supply header means, while the other ends of the pipes are connected to said refrigerant return header means.

2. The rink as claimed in claim 1 characterized in that said supply header means is provided along the side wall of the recess towards the span opposite to that in which the freezing pipes associated with the supply header means is mounted, and in that said return header means is provided along the side wall of the span opposite to that in which the freezing pipes associated with the return header means are mounted.

3. The rink as claimed in claim 1 characterized in that said supply header means towards the span in which the freezing pipes associated with the supply header means is mounted, and in that said return header means is provided along the side wall of the span in which the freezing pipes associated with the return header means are mounted.

4. The rink as claimed in claim 1 characterized in that said supply and return header means are provided along the one side wall of the recess.

5. The rink as claimed in claim 1 characterized in that said fixture means is capable of adjusting the height level of the crossing point of the freezing pipes.

6. The rink as claimed in claim 1 characterized in that the one ends of the respective freezing pipes are connected to said supply header means through sub-header means and the other ends of the pipes are connected to said return header means through sub-header means.

7. The rink as claimed in claim 1 characterized in that said supply header means is connected to said one sub-header means through flexible tube means and said return header means is connected to said another sub-header means through flexible tube means.

* * * * *